US006951481B2

(12) United States Patent
Dykstra et al.

(10) Patent No.: US 6,951,481 B2
(45) Date of Patent: Oct. 4, 2005

(54) COAXIAL CABLE CONNECTOR INSTALLABLE WITH COMMON TOOLS

(75) Inventors: John Dykstra, Tinely Park, IL (US); James Wlos, Crete, IL (US); Larry Buenz, Tinley Park, IL (US)

(73) Assignee: Andrew Corporation, Orland Park, IL (US)

( * ) Notice: Subject to any disclaimer, the term of this patent is extended or adjusted under 35 U.S.C. 154(b) by 45 days.

(21) Appl. No.: 10/708,859

(22) Filed: Mar. 29, 2004

(65) Prior Publication Data

US 2005/0020129 A1 Jan. 27, 2005

Related U.S. Application Data

(63) Continuation-in-part of application No. 10/604,670, filed on Jul. 23, 2003.

(51) Int. Cl.[7] ..... H01R 9/05
(52) U.S. Cl. ..... 439/578; 439/583
(58) Field of Search ..... 439/578, 579, 439/583, 584, 585, 63

(56) References Cited

U.S. PATENT DOCUMENTS

| | | | | |
|---|---|---|---|---|
| 4,422,715 A | | 12/1983 | Williams et al. | |
| 4,575,274 A | | 3/1986 | Hayward | 403/2 |
| 4,701,001 A | | 10/1987 | Verhoeven | |
| 4,706,384 A | | 11/1987 | Schreiber et al. | |
| 4,927,378 A | | 5/1990 | Song | |
| 5,314,349 A | | 5/1994 | Czeschka et al. | |
| 5,354,217 A | | 10/1994 | Gabel et al. | 439/583 |
| 5,660,565 A | | 8/1997 | Williams | |
| 5,722,856 A | * | 3/1998 | Fuchs et al. | 439/578 |
| 6,080,015 A | | 6/2000 | Andreescu | 439/584 |
| 6,267,621 B1 | * | 7/2001 | Pitschi et al. | 439/584 |
| 6,415,499 B1 | | 7/2002 | Holland et al. | |
| 6,733,336 B1 | * | 5/2004 | Montena et al. | 439/578 |
| 6,769,933 B2 | * | 8/2004 | Bence et al. | 439/578 |
| 2002/0031943 A1 | | 3/2002 | Kanda et al. | 439/573 |

* cited by examiner

*Primary Examiner*—Hien Vu
(74) *Attorney, Agent, or Firm*—Babrock IP, LLC

(57) ABSTRACT

A coaxial connector may be configured with multiple interleaved concentric threads that reduce connector assembly threading requirements. A cable sheath stripping feature may be incorporated into the connector, eliminating the need for a separate sheath stripping tool. Also, over-tightening protection assemblies may be incorporated in the coupling and or rear clamp nuts. The over-tightening protection assemblies utilize first and second interlock surfaces which co-operate to couple the connector body with a rotatable inner coupling sleeve until a predetermined level of torque is applied whereupon complementary protrusions formed on the rings deflect and slip past each other, protecting the connector and or cable from damage due to application of excessive torque and eliminating the need for torque wrenches during connector installation. The first and second interlock surfaces may be formed directly in the coupling nut and inner coupling sleeve or may be separate finger and ramp rings coupled to each.

7 Claims, 13 Drawing Sheets

COAXIAL CABLE CONNECTOR INSTALLABLE WITH COMMON TOOLS

CROSS REFERENCE To RELATED APPLICATIONS

This is a continuation-in-part of U.S. patent application Ser. No. 10/604,470, filed Jul. 23, 2003 which is hereby incorporated herein by reference.

BACKGROUND OF INVENTION

1. Field of the Invention

The present invention generally relates to coaxial cable connectors. More specifically, the present invention relates to a coaxial cable connector with ease of installation features that is installable with reduced connector specific tooling requirements.

2. Description of the Prior Art

Coaxial cable connectors are used, for example, in communication systems requiring a high level of reliability and precision. A connector that is poorly installed may damage equipment, significantly degrade system performance and or lead to premature system failure. Therefore, prior connectors typically include extensive installation instructions that require costly specialized tools specific to each connector.

One specialized tool for connectors is the jacket stripper. The jacket stripper is used to accurately strip away outer sheathing from the coaxial cable to expose a specified length of outer conductor for electrical contact with the desired surfaces of the connector. If the amount of outer sheathing removed is short, long or non-uniform, the electrical connection and or the environmental seal of the connector to the cable may be degraded.

Connectors may be used in confined spaces, for example among banks of cables with minimal spacing between them. Confined spaces increase the difficulty of proper connector installation and or interconnection by increasing the time required to make repeated small turns allowed by the confined space when threading the connectors by hand and or with the aid of a wrench. Also, connectors may be installed in exposed locations such as the top of radio towers where installation personnel may be less inclined to properly follow time-consuming installation procedures.

Threaded connections on and between connectors are typically tightened using wrenches having the potential for large moment arm force generation that may damage the connector and or associated cable(s). Therefore, use of a torque wrench with a torque setting specific to each connector is often specified by the prior connector installation instructions. Applying the proper torque, for example 15–20 lb-inches, to threaded connections ensures correct electrical interconnection and prevents application of excessive force that may deform or otherwise damage threads, seals and or the relatively soft metal(s) of the cable(s). The torque wrench is a costly and easily damaged tool that the installation personnel may not always have on hand or bother to use correctly, if at all.

Competition in the coaxial cable connector market has focused attention on minimization of overall costs, including training requirements for installation personnel, reduction of dedicated installation tooling and the total number of required installation steps and or operations.

Therefore, it is an object of the invention to provide a connector that overcomes deficiencies in the prior art.

BRIEF DESCRIPTION OF DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
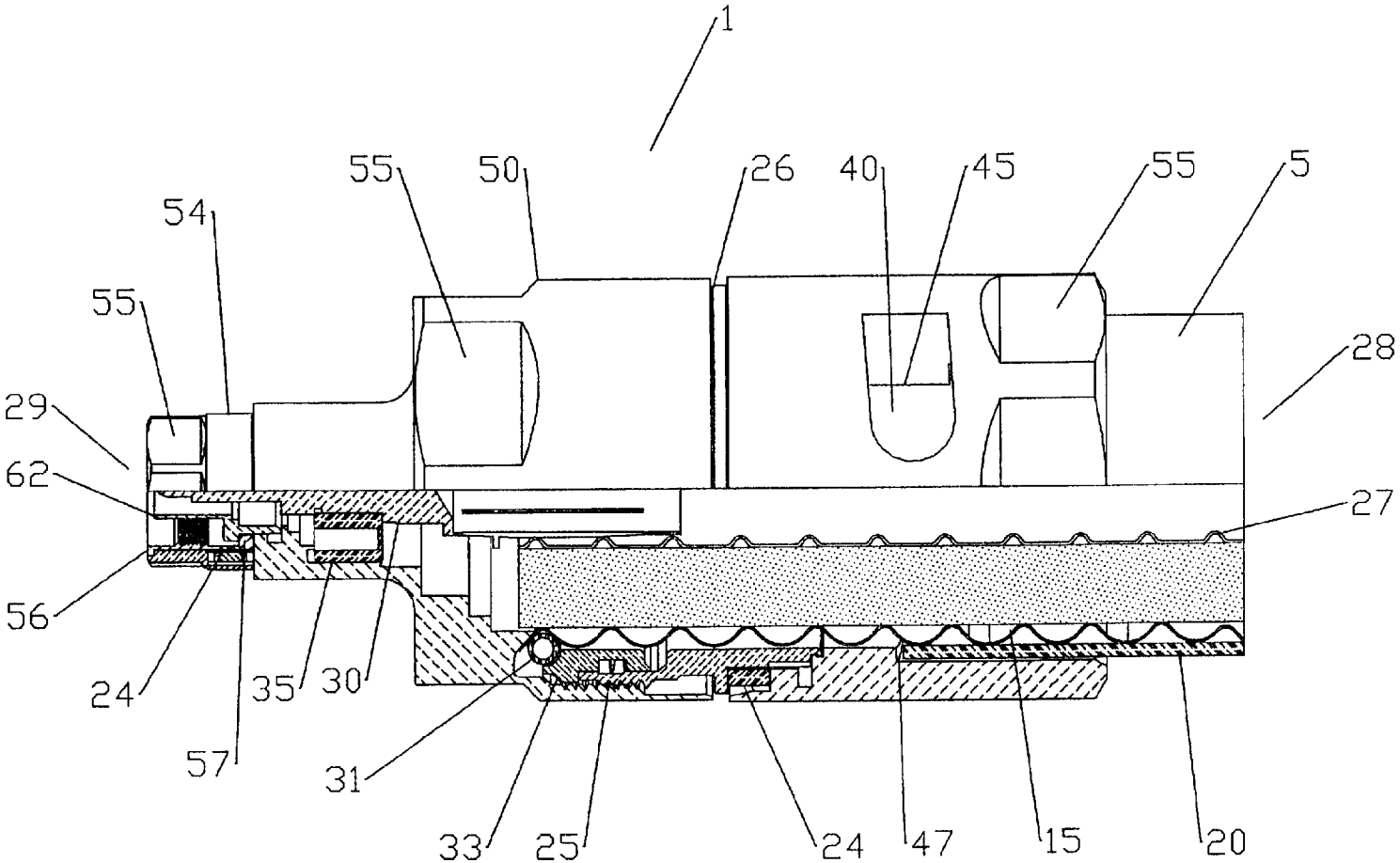
FIG. 1 is a partial cut-away side view of a coaxial connector according to one embodiment of the invention and a coaxial cable for receiving the connector.

As shown in FIG. 1, a connector 1 for use with a coaxial cable 5 has a rear clamp nut 10 adapted to fit over an end portion of the cable 5. A sheath 20 of the cable 5 is removed from the end of the cable 5 to expose the outer conductor 15. Threads 25 operate to clamp the outer conductor 15 between the connector body 50, a circular coil spring 31, a thrust collar 33 and a first inner coupling sleeve 26 coupled to the rear clamp nut 10 via an over-tightening protection assembly 24, described herein below, to secure the connector 1 to the cable 5. If the over-tightening protection assembly 24 feature is not used, the threads 25 may be formed on the clamp nut 10 and the first inner coupling sleeve 26 omitted. Also, the circular coil spring 31 may be omitted and the outer conductor 15 clamped directly between the connector body 50 and the first inner coupling sleeve 26 or the rear clamp nut 10. An inner conductor 27 of the coaxial cable 5 engages an inner contact 30 of the connector 1 that is spaced away from the outer conductor 15 mating surfaces by an insulator 35.

Figure 2:
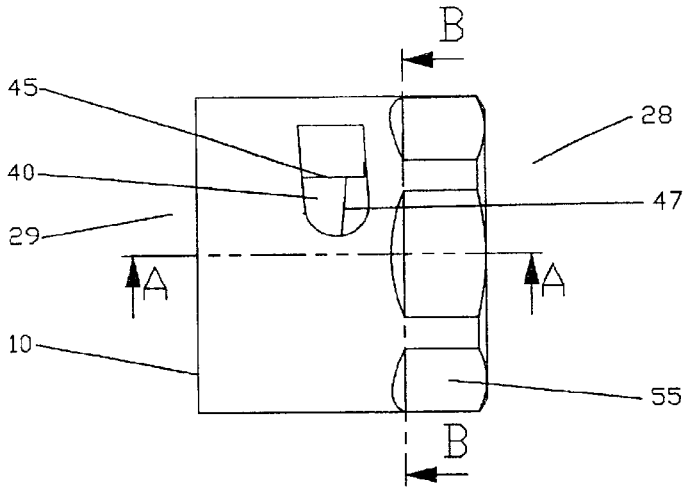
FIG. 2 is an external side view of a rear clamp nut according to one embodiment of the invention.
Figure 3:
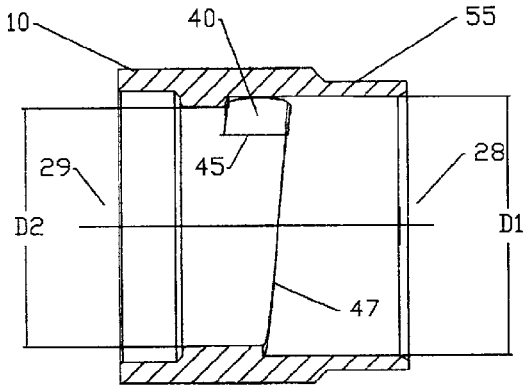
FIG. 3 is a side section view, along line A—A, of FIG. 2.
Figure 4:
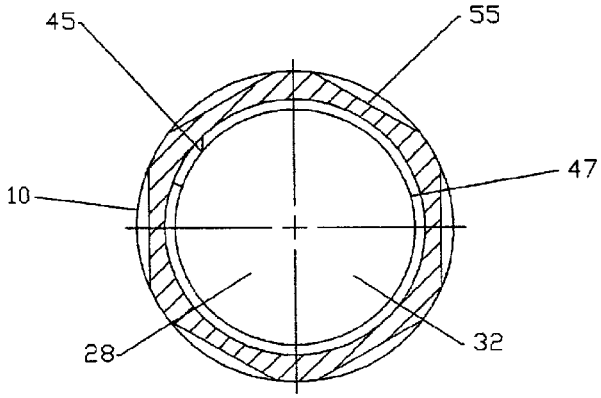
FIG. 4 is an end section view, along line B—B, of FIG. 2.

A cable stripping feature of the connector 1 is demonstrated by FIGS. 2–4 which show a simplified version of the rear clamp nut 10. The rear clamp nut 10 has a rear clamp nut bore 32 with a first inner diameter D1 at the cable end 28 of the connector 1 adapted to receive the coaxial cable 5 with sheath 20. A smaller second inner diameter D2 of the rear clamp nut bore 32 at a connection end 29 is adapted to receive only the outer conductor 15 of the cable 1.

A slot 40 formed in the rear clamp nut 10 has a cutting edge 45 at the end of a helical step 47 between the first inner diameter D1 and the second inner diameter D2. When the rear clamp nut 10 is placed over the end of the cable 5, the sheath 20 bottoms against the helical step and the cutting edge 45. Rotating the rear clamp nut 10 about the cable 5 drives the sheath 20 against the cutting edge 45 which cuts and separates the sheath 20 from the outer conductor 15. The cut portion of the sheath 20 exits through the slot 40 as the rear clamp nut 10 is advanced over the cable 5. The sheath 20 is trimmed to the correct length, for example, when the outer conductor 15 reaches the connection end of the rear clamp nut 10.

Figure 5:
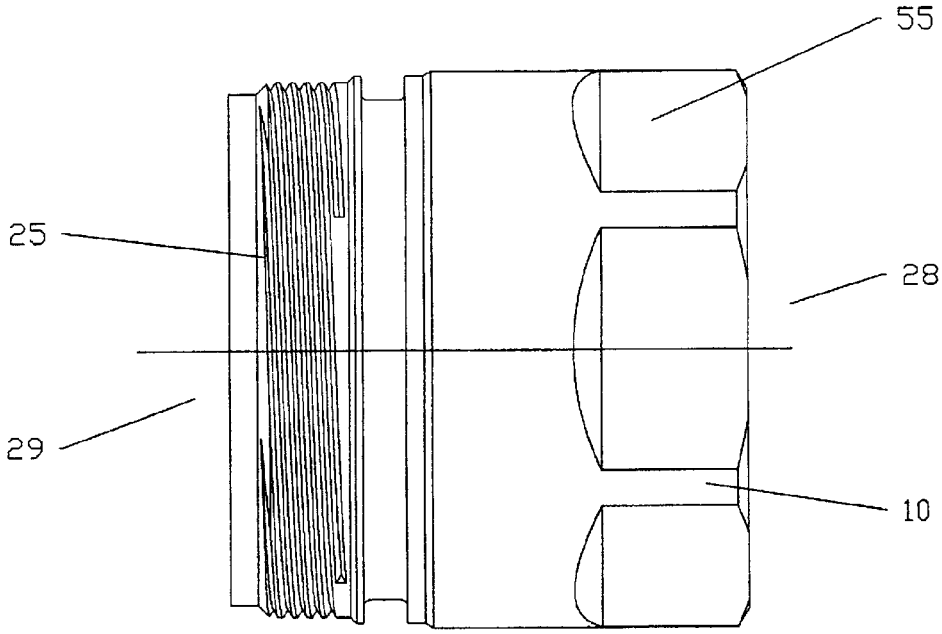
FIG. 5 is an external side view of a rear clamp nut according to another embodiment of the present invention.

The rear clamp nut 10 may be attached to the connector body 50 via threads 25 shown in detail on FIG. 5. The threads 25 comprise four interleaved concentric threads equally spaced from each other along the length of the connector. Each of the four threads has the same lead with thread ends spaced 90 degrees apart from each other around the axis of the connector 1. The interleaved threads 25 have a pitch that is four times normal, resulting in threaded assembly of the connector 1 requiring only one quarter the number of turns compared to a common single thread. Because the threads 25 are interleaved, the threads maintain the same overall thread to thread contact area resulting in a thread 25 with strength comparable to common single threading but with a pitch that is increased by a factor of 4. In alternative embodiments, use of two or three interleaved concentric threads will result in a one half or one third reduction, respectively, in the number of turns required to attach the rear clamp nut 10 to the connector body 50. Flats 55 formed in the outer surface of the rear clamp nut 10 and connector body 50 provide tool surfaces for the tightening of rear clamp nut 10 against the connector body 50.

One or more over-tightening protection assembly(s) 24 of the connector 1 prevents damage from over tightening of the coupling nut 54 and or rear clamp nut 10 to the coupling nut 54, connector body 50, rear clamp nut 10 (if present), threads, seals and or the relatively soft metal(s) of the cable(s). A separate over-tightening protection assembly 24 may be applied to operate with respect to the threads 25 and the connector threads 56, each with a separate desired torque rating.

Figure 6:
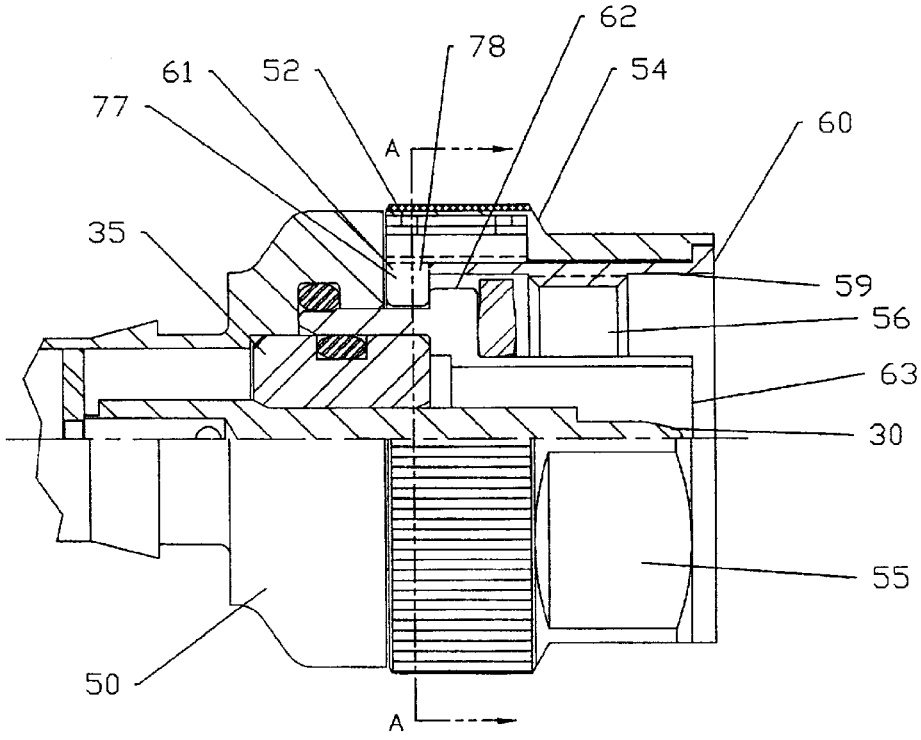
FIG. 6 is a partial cut-away side view of a coaxial connector according to another embodiment of the invention.
Figure 7:
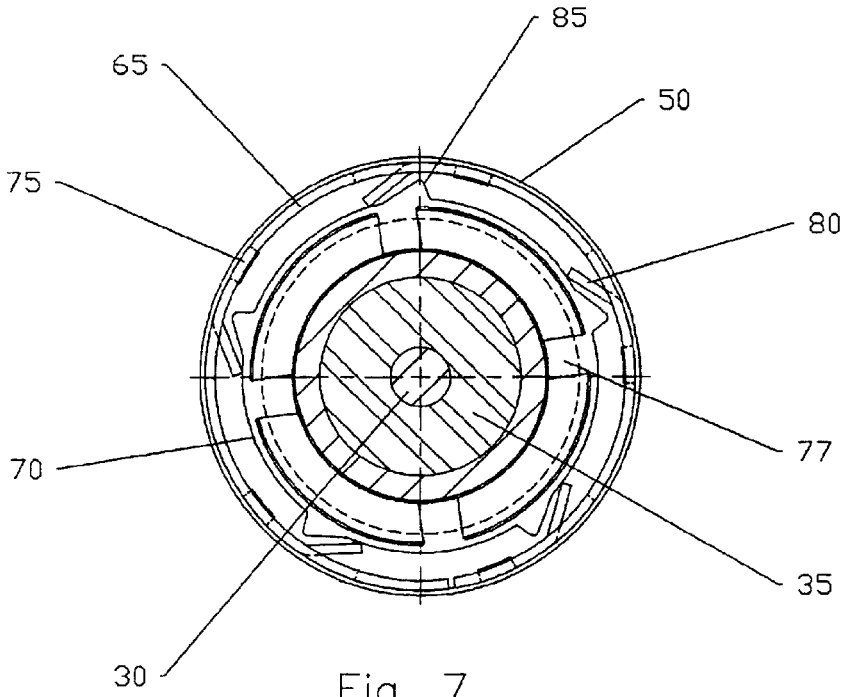
FIG. 7 is an end section view, along line A—A, of FIG. 6.
Figure 8:
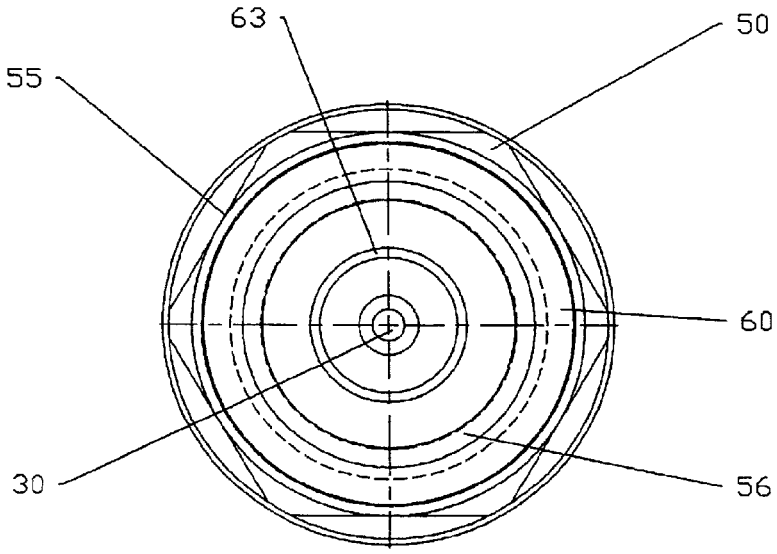
FIG. 8 is an end view of FIG. 6.

The over-tightening protection assembly 24 is first explained with the aid of a simplified version of connector 1, as shown in FIGS. 6–8, having an over-tightening protection assembly 24 in the coupling nut 54. The coupling nut 54 has an aperture dimensioned to accept a second inner coupling sleeve 60. The second inner coupling sleeve 60 has connector threads 56 located on an inner diameter 59 for coupling with other connectors and or equipment. Where the mating threaded surface is similarly configured, the connector threads 56 may be multiple interleaved concentric threads as described herein above. The second inner coupling sleeve 60 may be retained upon the connector body 50 in a rotatable configuration by an inward protruding coupling sleeve flange 61 that overlaps a corresponding outer protruding interface flange 62 of an interface 63 that is, for example, press fit into the cable end 28 of the connector body 50.

One skilled in the art will appreciate that an over-protection assembly 24 may likewise be incorporated in the rear clamp nut 10 as shown in FIG. 1.

Where the over-tightening protection assembly 24 is implemented with respect to the rear clamp nut 10, the description herein below with respect to the second inner coupling sleeve is similarly applied to the first inner coupling sleeve 26 or the like.

Figure 11:
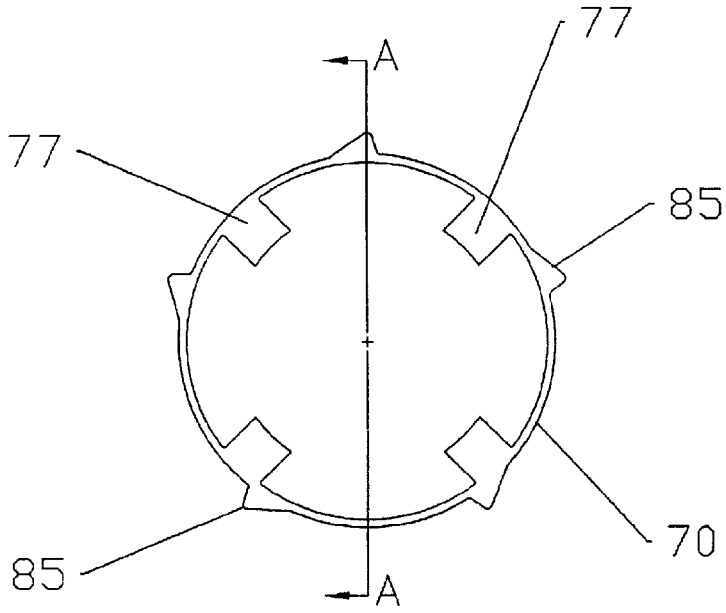
FIG. 11 is an end view of a ramp ring according to the embodiment of the invention shown in FIGS. 6–8.
Figure 12:
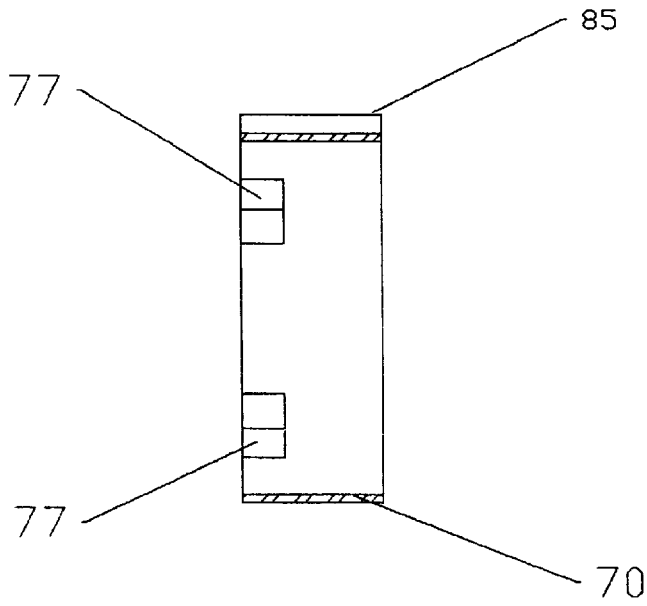
FIG. 12 is a side view of the ramp ring shown in FIG. 11.
Figure 13:
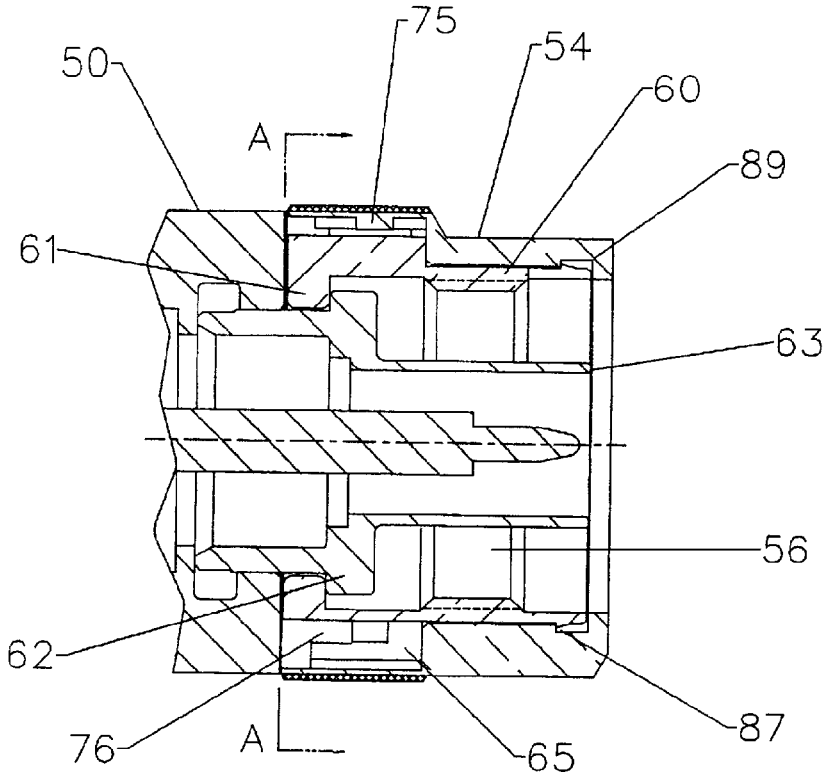
FIG. 13 is a partial side section view of a connector according to a second embodiment of the invention.
Figure 14:
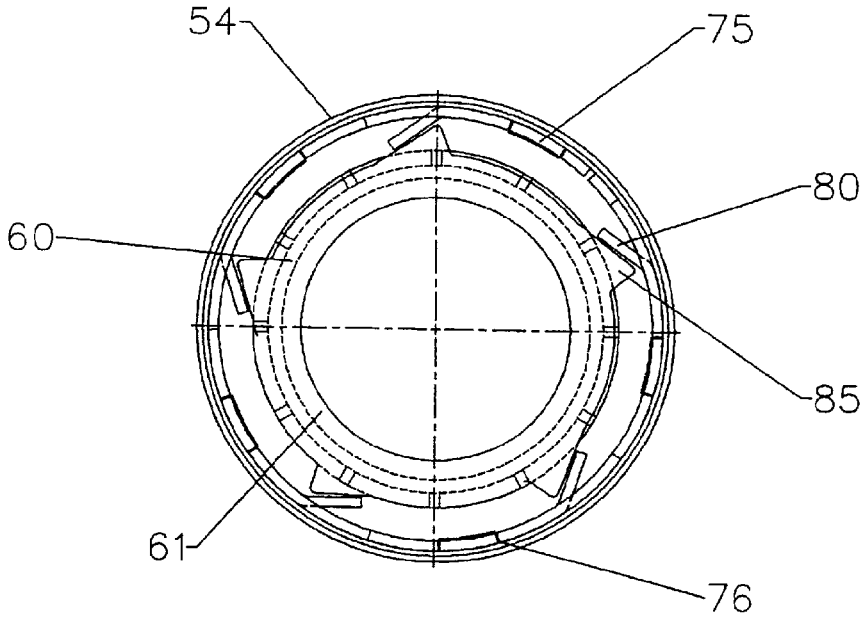
FIG. 14 is an end cross-section view, along line A—A of FIG. 13.

Rotation of the coupling nut 54 is coupled, within a selected torque range, to the second inner coupling sleeve 60 by a first interlock surface coupled to the coupling nut 54 and a corresponding second interlock surface coupled to the second coupling sleeve 60, the first interlock surface and the second interlock surface having complementary protrusions. Here, the first and second interlock surfaces are formed in a finger ring 65, as shown for example in FIGS. 9 and 10, and a ramp ring 70, as shown for example in FIGS. 11 and 12. The finger ring 65 and the ramp ring 70 are located coaxially within a step or groove 52 formed in the coupling nut 54.

The finger ring 65 may be keyed to the coupling nut 54 by a plurality of first ring tab(s) 75 distributed around the inner diameter of the groove 52 which interlock with corresponding finger ring slot(s) 76 in the finger ring 65. Similarly, the ramp ring 70 may be keyed to the second inner coupling sleeve 60 by a plurality of inward projecting second ring tabs 77 that couple with inner coupling sleeve slot(s) 78 formed in, for example, a cable end of the second inner coupling sleeve 60. Finger(s) 80 projecting inward from the finger ring 65 engage the ramp(s) 85 extending outwards from the ramp ring 70.

Rotation of the coupling nut 54 is transmitted to the second inner coupling sleeve 60 for threading of the connector threads 56 until a predetermined torque value is reached whereupon the finger(s) 80 of the finger ring 65 and or the ramp(s) 85 of the ramp ring 70 momentarily deflect/deform and slip past the ramp ring 70 or vice versa, preventing application of out of range torque levels to the second inner coupling sleeve 60 and thereby to the connector threads 56, gaskets and or the relatively soft metal(s) of the cable(s). During reverse rotation, the finger(s) 80 impact a step side of the ramp(s) 85 having an increased angle ensuring that increased torque levels sufficient to enable unthreading of the connector 1 may be applied.

The torque value at which the finger ring 65 slips past the ramp ring 70 may be adjusted, for example, by selecting materials with desired bending/deformation characteristics; adjusting the angles of the mating surfaces of the finger(s) 80 and or ramp(s) 85; and or modifying the thickness of the selected material(s). The finger ring 65 and or the ramp ring 70 may be formed using a wide range of techniques including, for example, machining, metal stamping, bending and ring rolling of metallic stock or injection molding from a material such as plastic, nylon, polycarbonate, ABS or the like. The positions of the finger and ramp ring pairs may be switched and or either or both of the first and second rings replaced with other forms of complementary protrusions and or interlocking structures of which at least one of a complementary pair will temporarily or permanently deflect/deform and release the connector body 50 to second inner coupling sleeve 60 interlock when the applied rotation torque reaches a desired threshold level. For example, interlocking protrusions, bumps, arches and or leaf springs may be used with an equivalent effect according to the invention.

Figure 9:
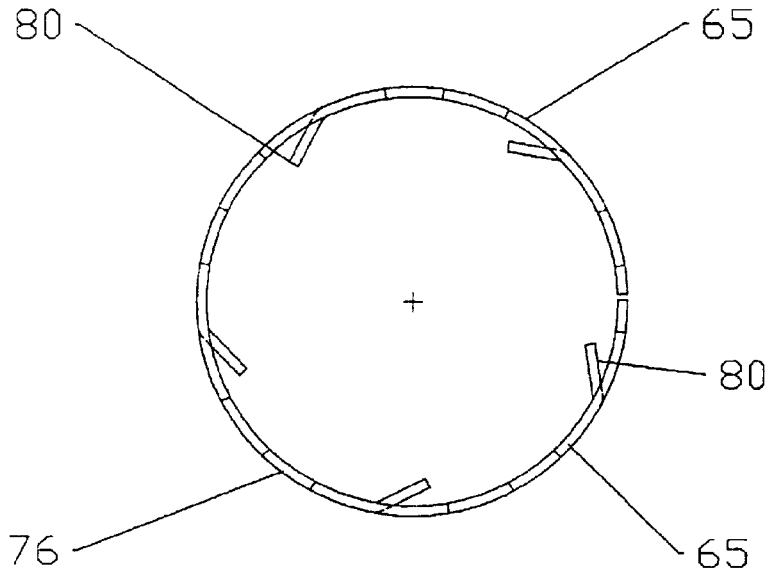
FIG. 9 is an end view of a finger ring according to the embodiment of the invention shown in FIGS. 6–8.
Figure 10:
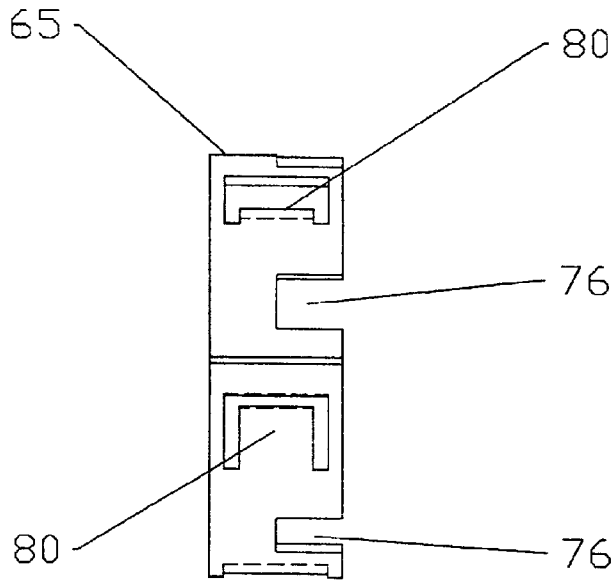
FIG. 10 is a side view of the finger ring shown in FIG. 9.
Figure 15:
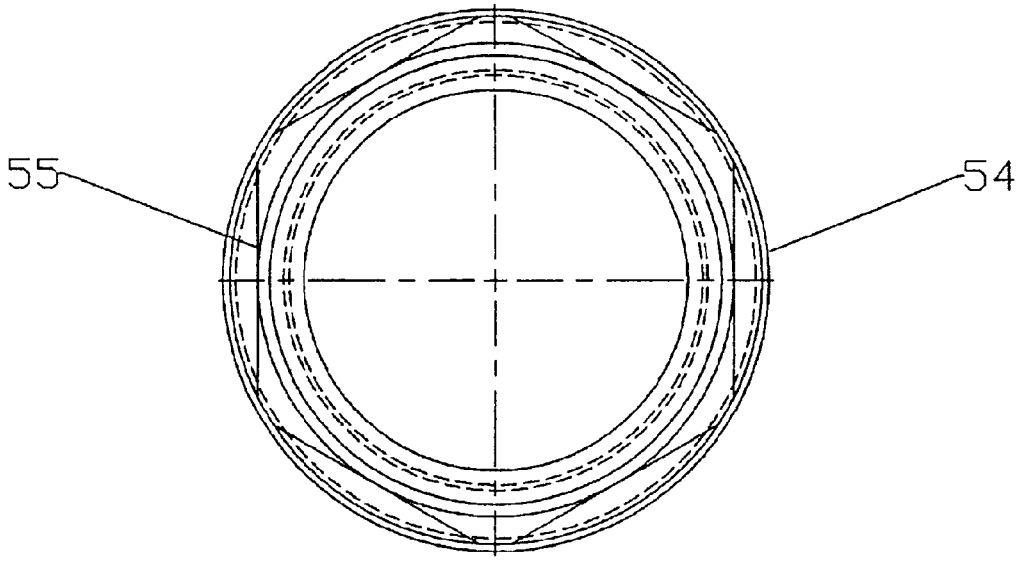
FIG. 15 is an end view of a coupling nut according to the second embodiment of the invention.
Figure 16:
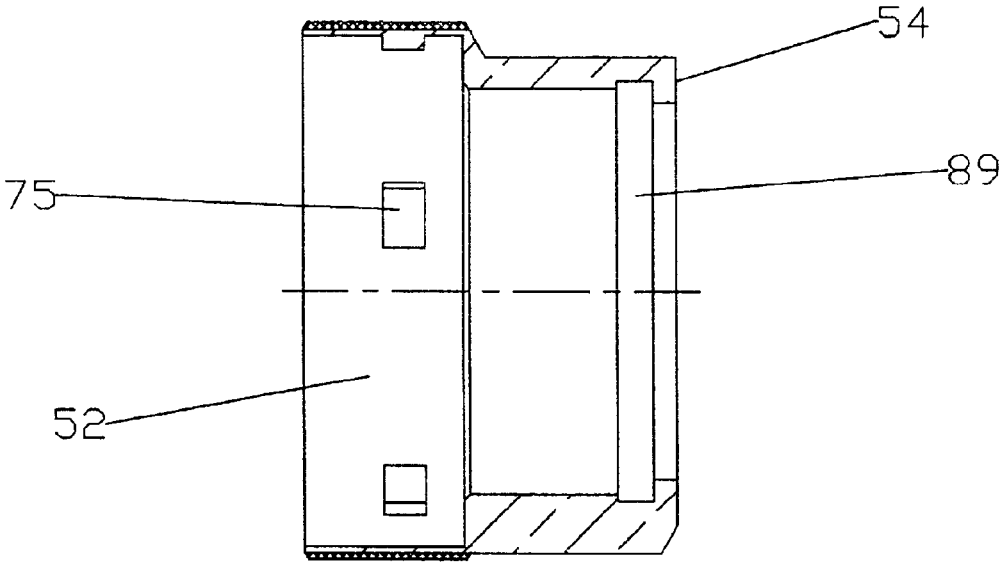
FIG. 16 is a cross-section view of the coupling nut of FIG. 15.

The overall size of the resulting assembly, manufacturing operations and total number of components may be reduced by incorporating the second inner coupling sleeve 60 or coupling nut 54 with the finger ring 65 and or ramp ring 70 interlocking protrusion(s) functionality. As shown in a second embodiment using a metal finger ring 65, demonstrated by FIGS. 13–18, like elements similarly notated, the ramp(s) 85 are integrated with the second inner coupling sleeve 60. The coupling nut 54, as shown in FIGS. 15 and 16 again uses a plurality of first ring tab(s) 75 to rotatably interlock with finger ring slot(s) 76 of a finger ring 65, as shown in FIGS. 9 and 10, dimensioned for press fitting within the groove 52.

Figure 17:
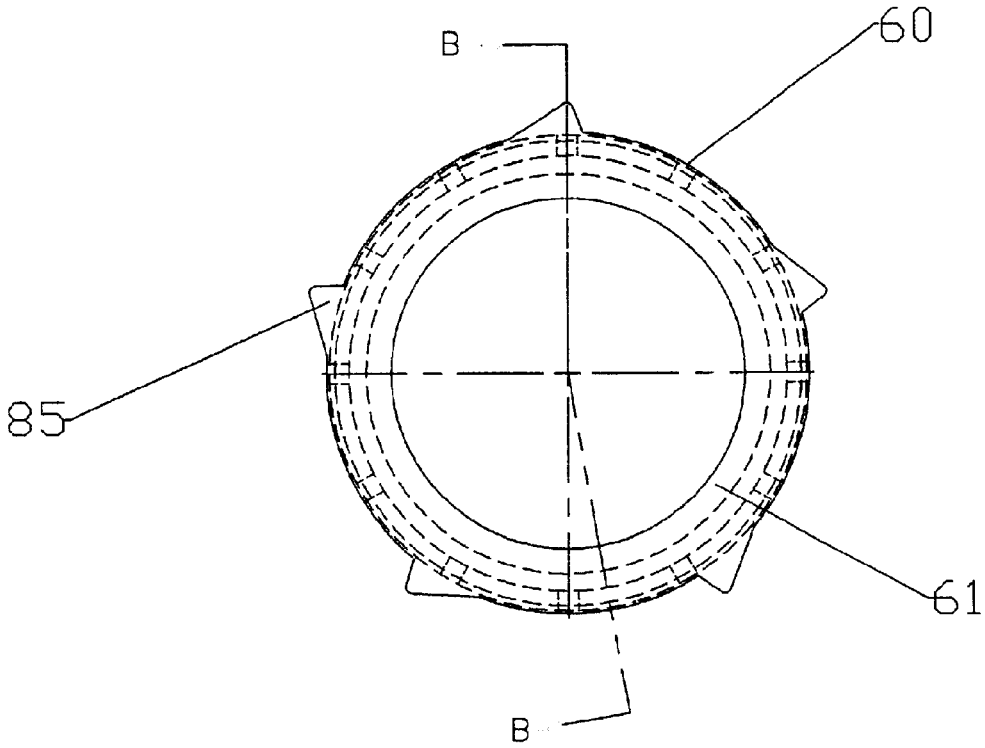
FIG. 17 is an end view of an inner coupling sleeve according to the second embodiment of the invention.
Figure 18:
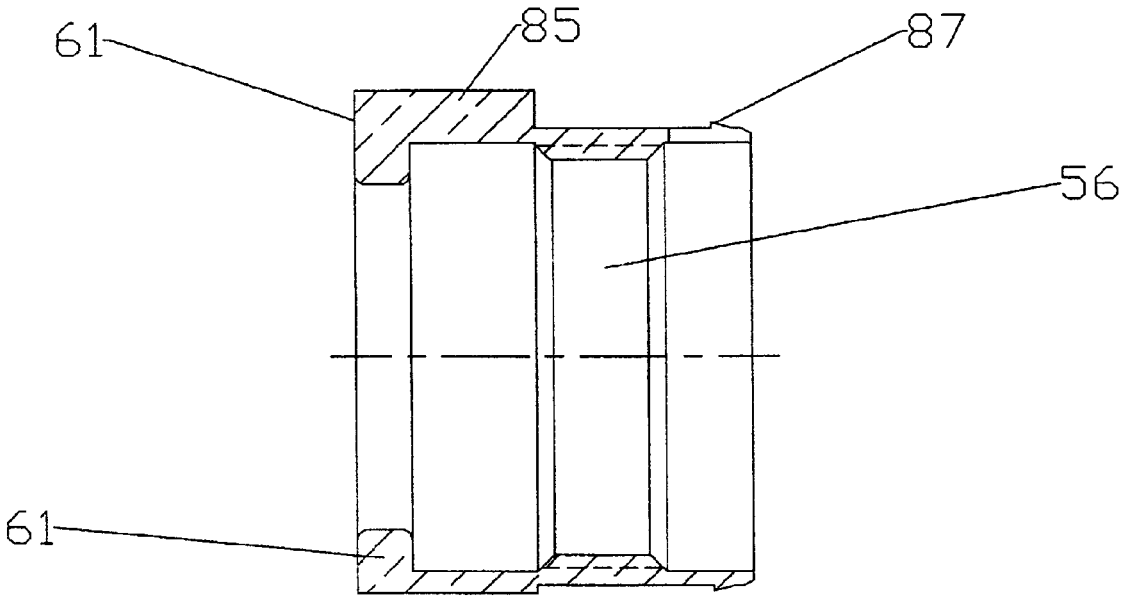
FIG. 18 is a cross-section view along line B—B of FIG. 17.
Figure 19:
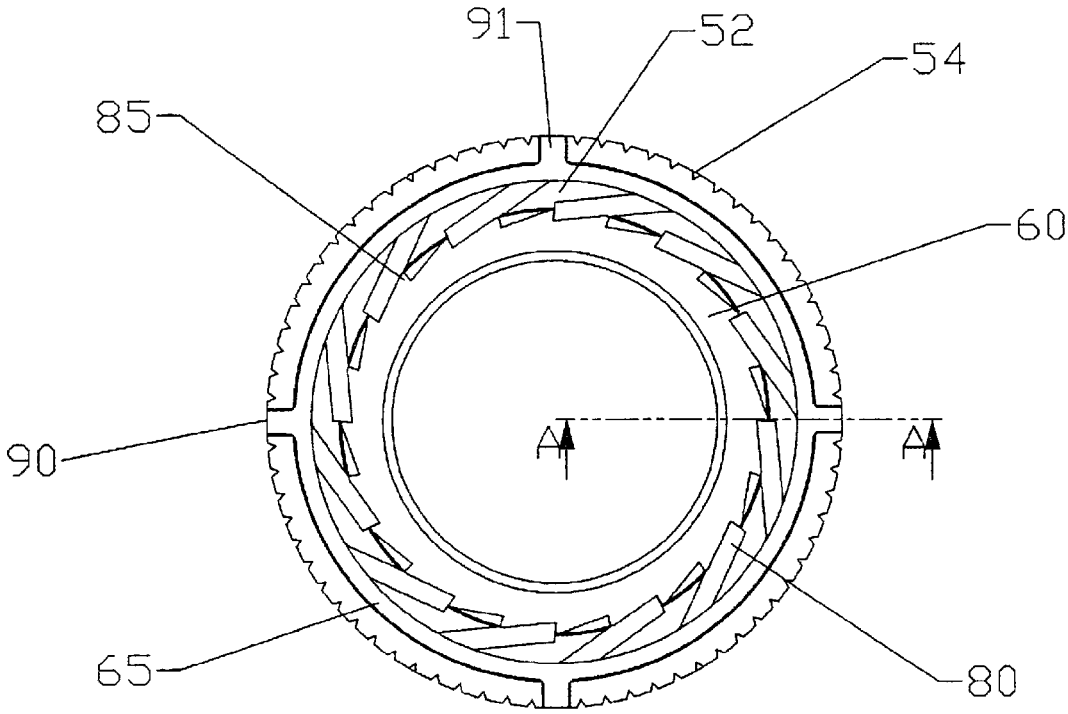
FIG. 19 is a connector end view of a coupling nut assembly according to a third embodiment of the invention.
Figure 20:
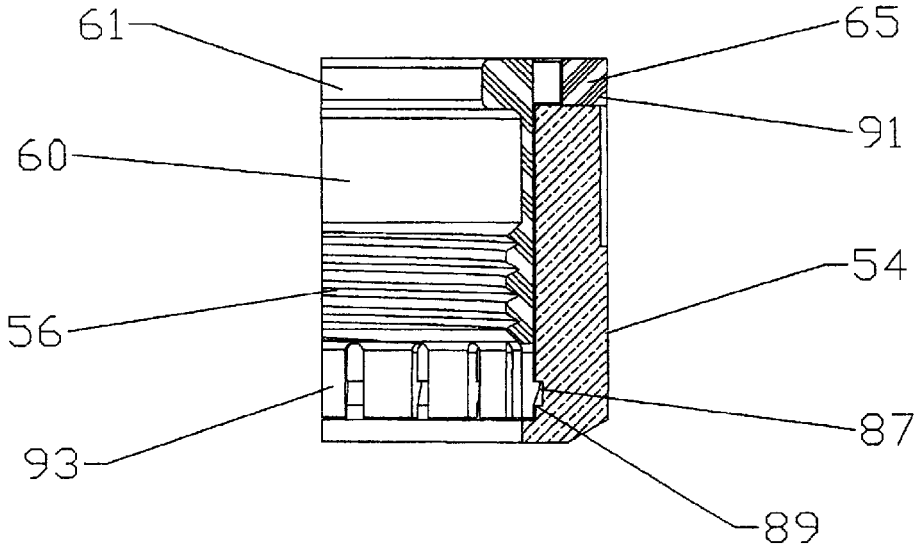
FIG. 20 is a partial cross-section view along line A—A of FIG. 19.
Figure 21:
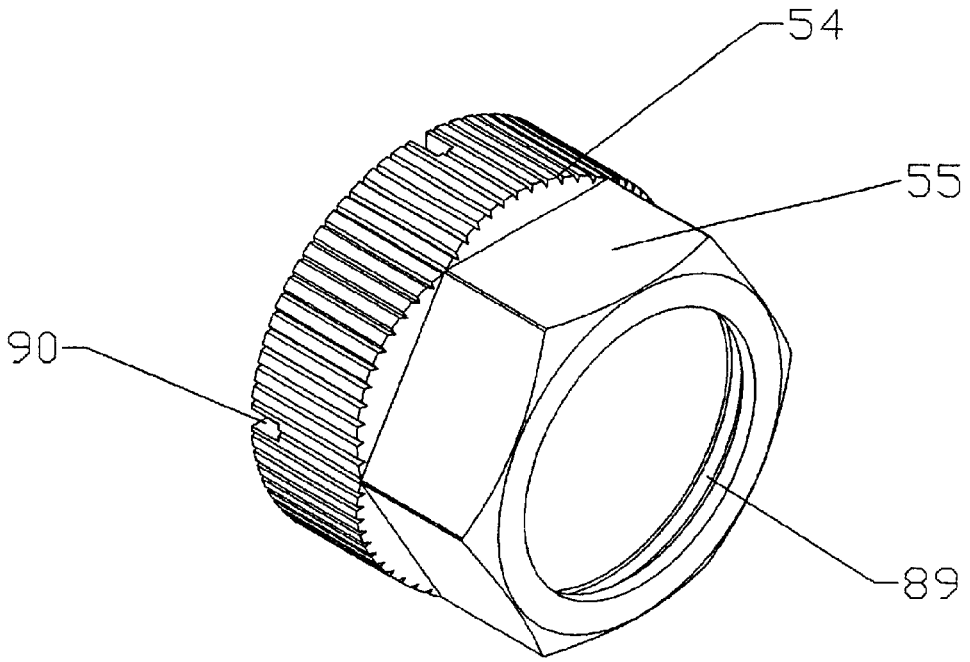
FIG. 21 is an isometric view of a coupling nut according to the third embodiment of the invention.
Figure 22:
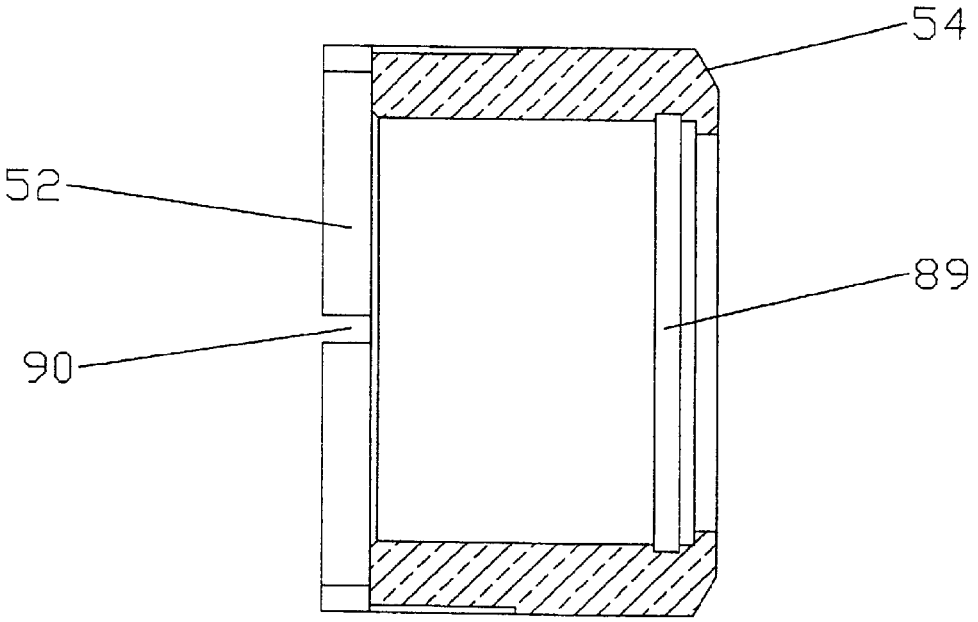
FIG. 22 is a cross-sectional side view of the coupling nut of FIG. 21.
Figure 23:
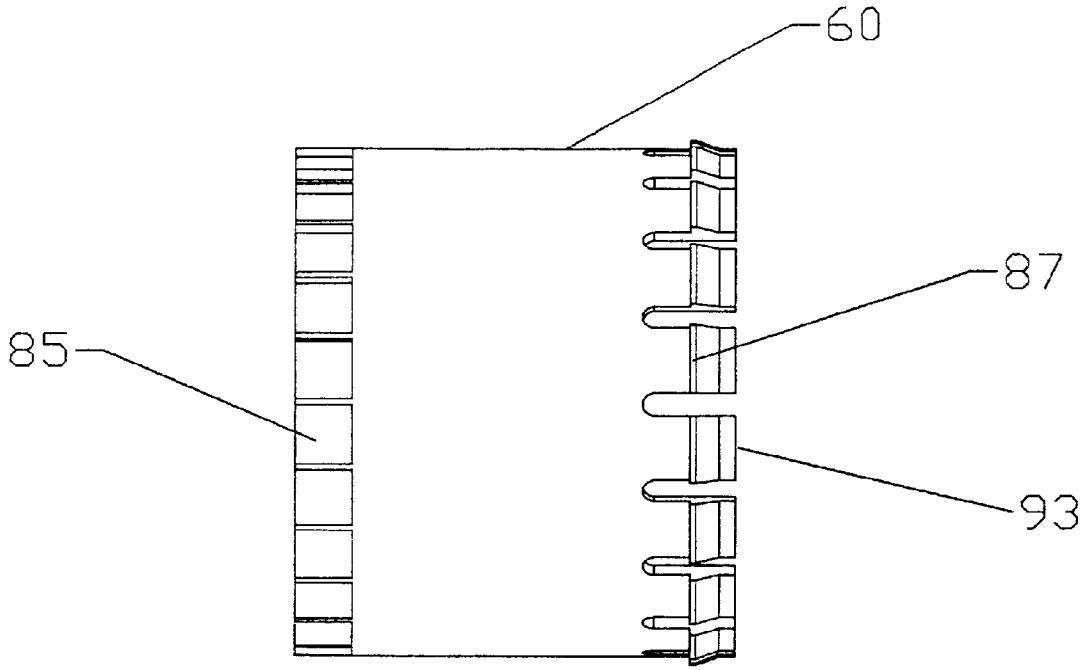
FIG. 23 is an external side view of an inner coupling sleeve according to the third embodiment of the invention.
Figure 24:
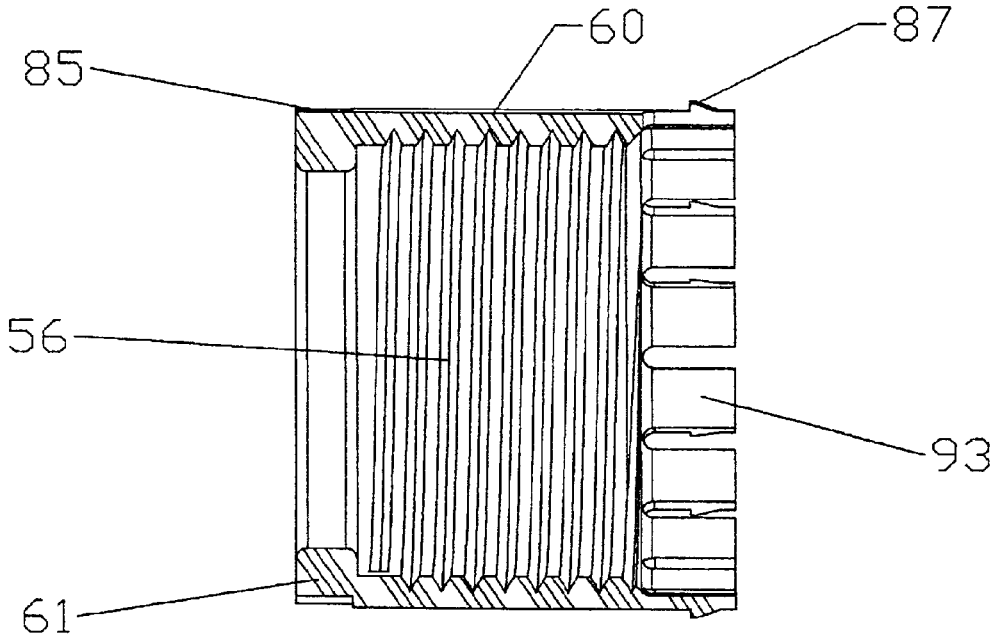
FIG. 24 is a cross-section side view of the inner coupling sleeve of FIG. 23.
Figure 25:
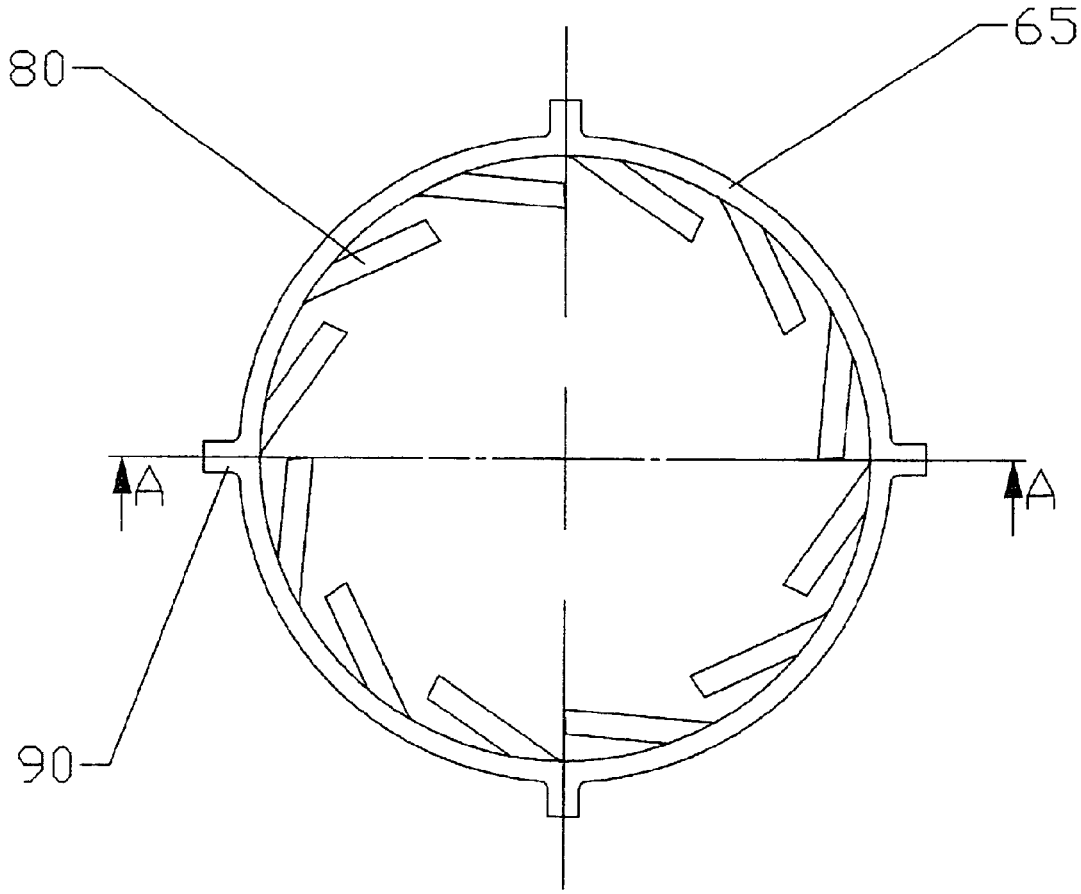
FIG. 25 is an end view of a finger ring according to the third embodiment of the invention.
Figure 26:
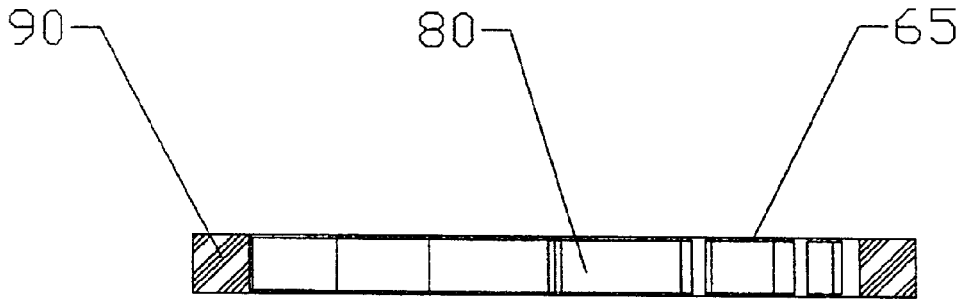
FIG. 26 is a cross section view along line A—A of FIG. 25.

In the second embodiment, the second inner coupling sleeve 60, as shown in FIGS. 17 and 18 is retained within the coupling nut 54 by a lip edge 87 formed around a connector end 29 of the second inner coupling sleeve 60. The lip edge 87 snaps into and is rotatably retained within a corresponding coupling sleeve retention groove 89 as the second inner coupling sleeve 60 is inserted within the coupling nut 54.

As shown by FIGS. 19–26, a third embodiment demonstrates, for example, adaptations for a finger ring 65 formed from a plastic material. The finger ring 65 has a simplified mounting within the groove 52 via a plurality of first ring slot(s) 90 formed around a cable end 28 of the coupling nut 54 which receive corresponding outwardly projecting fin(s) 91 of the finger ring 65. To allow for the lower strength available from plastic material, the number of finger(s) 80 and corresponding ramp(s) 85 may be increased. The lip edge 87 may be formed using a plurality of individual tine(s) 93 formed at the connector end of the second inner coupling sleeve 60.

The connector 1 may be adapted to mate with the dimensions and configuration of a specific coaxial cable 5, for example a coaxial cable with annular or helical corrugations in the inner and or outer conductors 27, 15. Further, the connector end of the connector 1 may be adapted to mate according to male and or female embodiments of a proprietary interface or any of the standard connector types, for example Type-F, BNC, Type-N or DIN.

The present invention provides coaxial connectors with ease of installation features and reduces specialized installation tool requirements. The sheath stripping cutting edge slot eliminates the need for a dedicated sheath stripping tool and strips the sheath to the correct outer conductor exposure during connector assembly without requiring a separate stripping step. Interleaved threads allow the connector to be installed with a significantly reduced threading requirement. Also, protection from damaging excess torque application during connector installation and elimination of the need for torque wrenches may be built into the connector.

One skilled in the art will appreciate that the torque limiting coupling nut assemblies described herein may also be used in other, non-connector, applications where a torque limiting function is desirable. By removing the inner coupling sleeve flange 61, the torque limiting coupling nut assembly may be used as a replacement for any common threaded nut, providing the benefit of torque limitation to any threaded interconnection. For example, where nuts and bolts are used to secure glass panels and mirrors, torque limiting nuts according to the present invention may be used to limit the compression applied as the nut is tightened upon the bolt and thereby upon the glass panel.

Table of Parts

| | |
|---|---|
| 1 | connector |
| 5 | coaxial cable |
| 10 | rear clamp nut |
| 15 | outer conductor |
| 20 | sheath |
| 24 | over-tightening assembly |
| 25 | threads |
| 26 | first inner coupling sleeve |
| 27 | inner conductor |
| 28 | cable end |
| 29 | connector end |
| 30 | inner contact |
| 31 | circular coil spring |
| 32 | rear clamp nut bore |
| 33 | thrust collar |
| 35 | insulator |
| 40 | slot |
| 45 | cutting edge |
| 47 | step |
| 50 | connector body |
| 52 | groove |
| 54 | coupling nut |
| 55 | flats |
| 56 | connector threads |
| 59 | inner diameter |
| 60 | second inner coupling sleeve |
| 61 | inner coupling sleeve flange |
| 62 | interface flange |
| 63 | interface |
| 65 | finger ring |
| 70 | ramp ring |
| 75 | first ring tab |
| 76 | finger ring slot |
| 77 | second ring tab |
| 78 | inner coupling sleeve slot |
| 80 | finger |
| 85 | ramp |
| 87 | lip edge |
| 89 | coupling sleeve retention groove |
| 90 | first ring slot |
| 91 | fin |
| 93 | tine |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicants general inventive concept. Further, it is to be appreciated that improvements and/or modifications may be made thereto without departing from the scope or spirit of the present invention as defined by the following claims.

What is claimed is:

1. A coaxial connector for coupling a coaxial cable with a connection, comprising:

a connector body and an interface or engagement end coupled to the connector body;

a coupling nut coaxial with the interface and an inner coupling sleeve; the inner coupling sleeve having threads for coupling the interface with the connection; and an inner first interlock surface integral with an internal diameter surface of the coupling nut and an outward second interlock surface integral with an outer diameter surface of the inner coupling sleeve;

the first interlock surface and the second interlock surface each having a plurality of complementary protrusions;

the complementary protrusions of the first interlock surface and the second interlock surface interact whereby the coupling nut is coupled to the inner coupling sleeve during rotation of the coupling nut via application of a torque below a threshold level;

at least one of the complementary protrusions deflecting upon application of the torque at or above the threshold level to decouple the connector body from the inner coupling sleeve.

2. The connector of claim 1, wherein the first interlock surface is a finger ring coupled to the coupling nut and the complementary protrusions of the first interlock surface are a plurality of fingers extending inward from the finger ring.

3. The connector of claim 1, wherein the second interlock surface is a ramp ring coupled to the inner coupling sleeve and the complementary protrusions of the second interlocking surface is a plurality of ramps projecting outward from the ramp ring.

4. The connector of claim 1, wherein the second interlock surface has a plurality of ramps formed in an outer surface of the inner coupling sleeve.

5. The connector of claim 1, further including a rear clamp nut having a rear clamp nut bore with a first inner diameter at a cable end and a smaller second inner diameter at a connector end; the first inner diameter dimensioned to fit onto a coaxial cable with a sheath and the second inner diameter dimensioned to fit onto the cable without the sheath;

a helical step between the first inner diameter and the second inner diameter extends around the bore between the cable end and the connector end of a slot with a cutting edge; the cutting edge at the second inner diameter operating to cut and separate the sheath from the outer conductor as the cable is inserted into the bore and rotated; and the connector body adapted to connect to the rear clamp nut at the connector end.

6. The connector of claim 5, wherein the connector body and the rear clamp nut are connected via a plurality of interleaved concentric threads.

7. The connector of claim 6, wherein there are one of two, three and four interleaved concentric threads.

* * * * *

UNITED STATES PATENT AND TRADEMARK OFFICE

CERTIFICATE OF CORRECTION

PATENT NO. : 6,951,481 B2
DATED : October 4, 2005
INVENTOR(S) : John Dykstra et al.

It is certified that error appears in the above-identified patent and that said Letters Patent is hereby corrected as shown below:

Title page,
Item [74], *Attorney, Agent, or Firm*, "Babrock IP, LLC" should be
-- Babcock IP, LLC --.

Signed and Sealed this

Thirteenth Day of December, 2005

JON W. DUDAS
*Director of the United States Patent and Trademark Office*